United States Patent [19]

Sootome et al.

[11] Patent Number: 4,717,139

[45] Date of Patent: Jan. 5, 1988

[54] SHEET FEEDING APPARATUS

[75] Inventors: Sumitoshi Sootome, Yachiyo; Mototada Toriumi, Tokyo; Sohei Tanaka, Yokohama; Shinichi Sasaki, Fujisawa, all of Japan

[73] Assignee: Canon Kabushiki Kaisha, Tokyo, Japan

[21] Appl. No.: 844,689

[22] Filed: Mar. 27, 1986

[30] Foreign Application Priority Data

Mar. 29, 1985 [JP] Japan ..... 60-65462

[51] Int. Cl.[4] ..... B65H 3/06

[52] U.S. Cl. ..... 271/116; 271/118; 271/126; 74/113

[58] Field of Search ..... 271/118, 117, 116, 114, 271/126, 157, 160, 113; 355/14 SH, 3 SH; 74/113, 112, 125.5

[56] References Cited

U.S. PATENT DOCUMENTS

| | | | |
|---|---|---|---|
| 3,815,900 | 6/1974 | Schulze | 271/118 |
| 3,981,497 | 9/1976 | Feinstein, Jr. et al. | 271/117 X |
| 4,215,588 | 8/1980 | Komori et al. | 74/113 |
| 4,346,878 | 8/1982 | Aizawa | 271/118 |

*Primary Examiner*—Joseph J. Rolla
*Assistant Examiner*—David H. Bollinger
*Attorney, Agent, or Firm*—Fitzpatrick, Cella, Harper & Scinto

[57] ABSTRACT

A sheet feeding apparatus for sequentially feeding sheet material from a sheet supporting member which supports a stack of sheet material. The feeding apparatus employs a mechanism to cause a feeding roller to engage or disengage the stack. A driving source is provided for transmitting a driving force to the feeding roller and the mechanism for causing the feeding roller to engage or disengage the stack. First and second transmitting mechanisms are provided for transmitting the driving force to the feeding roller and the mechanism for causing engagement or disengagement of the feeding roller and stack respectively. A stop device movable between a position to allow transmission of the driving force to the first and second transmitting mechanisms and a position where the transmitting mechanisms are prevented from transmitting the driving force. The feeding roller, the mechanism causing engagement or disengagement of the feeding roller with the stack and the first and second transmitting mechanisms are disclosed as co-axial.

17 Claims, 7 Drawing Figures

SHEET FEEDING APPARATUS

FIELD OF THE INVENTION AND RELATED ART

The present invention relates to a sheet feeding apparatus for feeding sequentially sheet materials such as copy sheets or original documents, usable with an image forming apparatus such as a copying machine, a printer and a facsimile machine.

In a copying machine, for example, in order to automatically feed sheet materials such as transfer materials, there are two types of feeding system. In one of them, a cassette accommodating, a stack of transfer materials of a predetermined size, is loaded into the copying machine, wherein the sheets are fed out from the cassette one by one by feeding means such as a pick-up roller or the like provided within the copying machine. In the other, a stack of the transfer materials directly supported on a tray mounted to the copying machine is fed out one by one. In the latter case, what the operator should do is only to place several tens of the sheet materials directly on the tray, and therefore, it is not so cumbersome as in the former type, that is, the cassette type, since it is not necessary to attach the cassette to the copying machine or detach it therefrom. In the latter case, it is easy to supply the transfer materials, since the sheet materials are simply put on the tray.

FIG. 6 is a sectional view of a conventional feeding apparatus of the tray type feeding. The feeding device includes a feeding roller 1 rotatably mounted by a shaft l*a* to a main frame, which will be described hereinafter, a transfer material stacking member 2 having an unshown end which is pivotably mounted to the main frame, a spring for urging to the feeding roller the free portions of the transfer material stacking member 2, means 4 for separating the transfer material, which is pivotably mounted to the main frame by a shaft 4*a*, and a spring for urging to the feeding roller the free end of the separating member 4. The feeding device further includes transfer material separating sheets 6 and 7 such as resin pad or the like provided on the top surface of the transfer material separating member 4 adjacent its free end and on the transfer material stacking member 2.

In the feeding device of this type, the free end side of the transfer material stacking member 2 is always urged to the feeding roller side by the spring 3, and therefore, when the transfer material is supplied to the stacking member 2, it is required for the operator to move a lever or the like to lower the transfer material stacking member 2 against the force of the spring 3, and then the transfer material is supplied onto the stacking member so that the leading edge of the transfer material is directly under the feeding roller 1. This is cumbersome to the operator, and in addition, this is contradictory to the advantage of the tray type feeding device that the transfer materials can be supplied without difficulty.

FIG. 7 shows a feeding device which has been proposed as eliminating the drawback. In this Figure, the same reference numerals are assigned to the corresponding element. In this device, when the apparatus is not operating, the transfer material stacking member 2 is lowered by a cam plate 10 so as to allow easy insertion of the transfer materials P under the feeding roller 1. Upon the feeding operation, the cam plate 10 rotates to release the lowering action, and therefore, the leading edge of the transfer material P abuts the feeding roller 1 so as to perform the feeding operation. The cam plate 10 automatically stops its rotation after one full turn so as to abut the transfer material stacking plate 2 one for each paper feedings.

In this system, simultaneously with the releasing of the lowering operation by rotation of the cam plate 10 upon the transfer material feeding, the feeding roller starts rotating. This results in the following disadvantages. Usually, the leading edges of the sheet materials are not smooth, but they are waved or curled because of its material, ambient conditions and history thereof, for example, they may have been subjected to duplicate copying operation or superimposed copying operation or the like. When several tens of those sheet materials are stacked on the transfer material stacking member, and the feeding operation is effected, the timing of the sheet materials differs depending on the difference in the feed starting position of the sheet materials. This influences the feeding of the sheet materials in the subsequent stations, for example, the sheet can advance obliquely, or the wrinkling and the jamming of the sheet occur, or the quality of the image is degraded.

As for a solution to this problem, it is noted that in a cassette feeding type device, an intermediate bottom plate of the cassette is raised so that the topmost sheet of the stacked sheets is contacted to the feeding roller, and then, the feeding roller starts rotation, as disclosed in Japanese Patent Application Publication No. 8877/1977.

In the apparatus described above, the cam plate 10 must restore its original position through one full turn thereof. This limits the possible rotational angle of the feeding roller 1 which is operatively coupled with the cam plate 10. Therefore, it is difficult to adopt a structure wherein the diameter of the feeding roller 1 is made large so as to make the feeding operation easier, while the feeding roller 1 is stopped after its rotation not more than one full turn so as to limit the advancement of the sheet material.

SUMMARY OF THE INVENTION

Accordingly, it is a principal object of the present invention to provide a sheet feeding apparatus wherein a feeding roller is contactable to the sheet, and wherein the rotation of the feeding roller can be controlled without being limited by the operation of the means for contacting the feeding roller to the sheet and disengaging the feeding roller from the sheet.

According to an embodiment of the present invention, there is provided a sheet feeding apparatus comprising a feeding roller driven through a first clutch, a cam for contacting the feeding roller to, and disengaging it from, the sheet material, which is driven through a second clutch, a stop lever associated with said first and second clutches to engage and disengage them, wherein said cam maintains the feeding roller in non-contact state with the sheet materials upon non-feeding operation, whereas said stop lever operates, upon the feeding operation, so that the feeding roller starts rotating after contacting the sheet and stops its rotation before it is disengaged from the sheet material.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
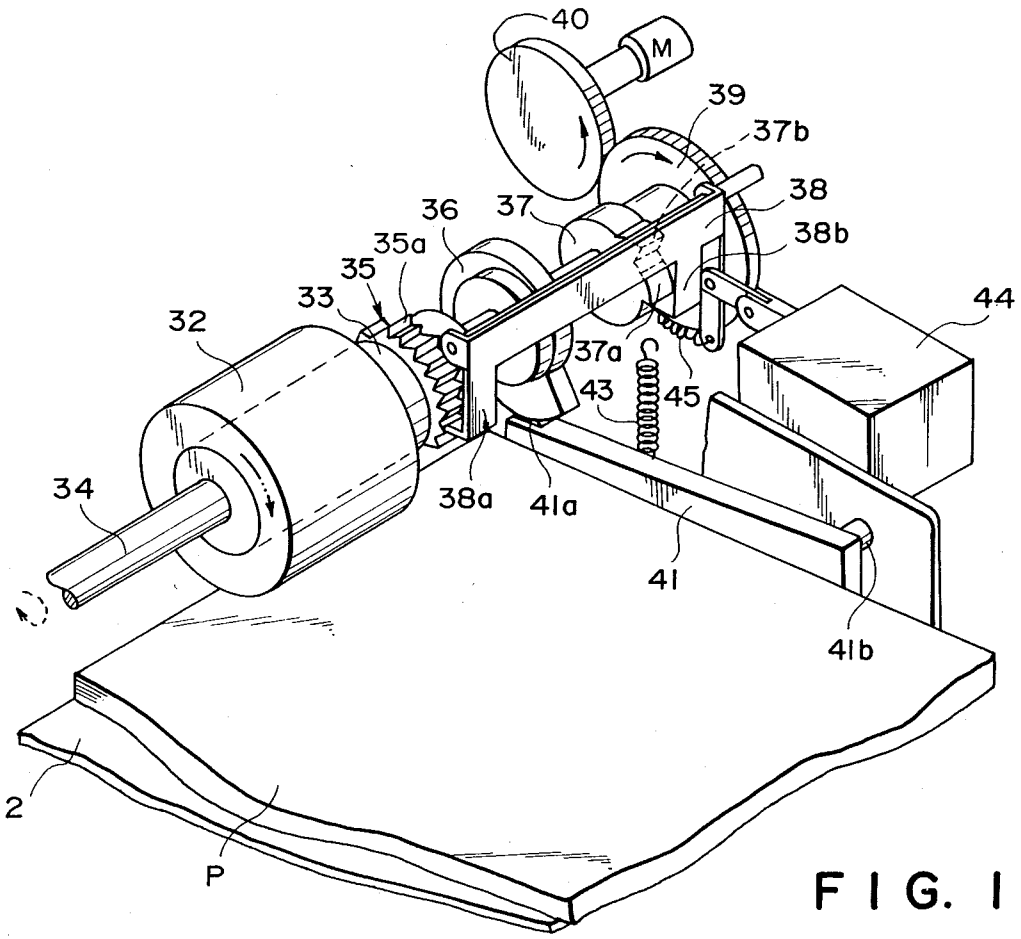
FIG. 1 is a perspective view of a feeding apparatus according to an embodiment of the present invention.

Referring now to FIG. 1, there is shown a sheet feeding apparatus according to an embodiment of the present invention, which comprises a feeding shaft 34 supporting a feeding roller 32. The shaft 34 is connected with a core shaft 33 of the feeding roller so that the drive transmission can be established or disengaged by a spring clutch 35.

Opposed to the feeding roller 32, a transfer material stacking member or tray 2 is disposed pivotably about a pin 41*b*. Adjacent the free end of the transfer material stacking member 2, an end of a spring 43 is engaged so as to urge the transfer material stacking member 2, and therefore the sheet thereon, to the feeding roller 32. To the feeding shaft 34, a cam plate 36 is fixed. The cam plate 36 is engageable with a cam follower 41*a* mounted to the sheet stacking member 2. The sheet feeding shaft 34 is equipped with a one rotation spring clutch 37, so that the driving force transmitted to the feeding gear 39 by way of a gear 40 is disengageably transmitted to the shaft 34 by the one rotation spring clutch 37. This one rotation spring clutch 37 and the above described spring clutch 35 for the feeding roller 32 are controlled by a lever 38 operatively coupled with a single electromagnetic solenoid 44. The solenoid 44 and the lever 38 constitute control means for stopping the feeding roller 32 at a desired angular position.

Figure 2:
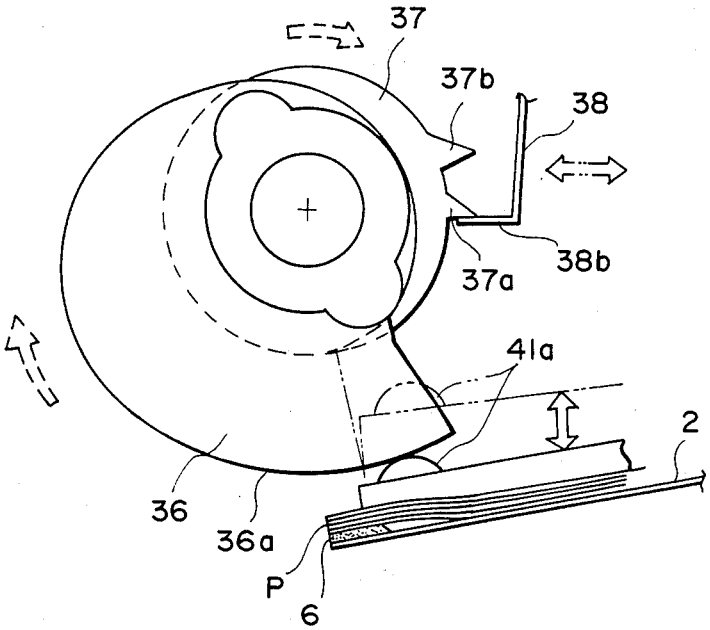
FIG. 2 is an enlarged side view of the apparatus of FIG. 1.
Figure 3:
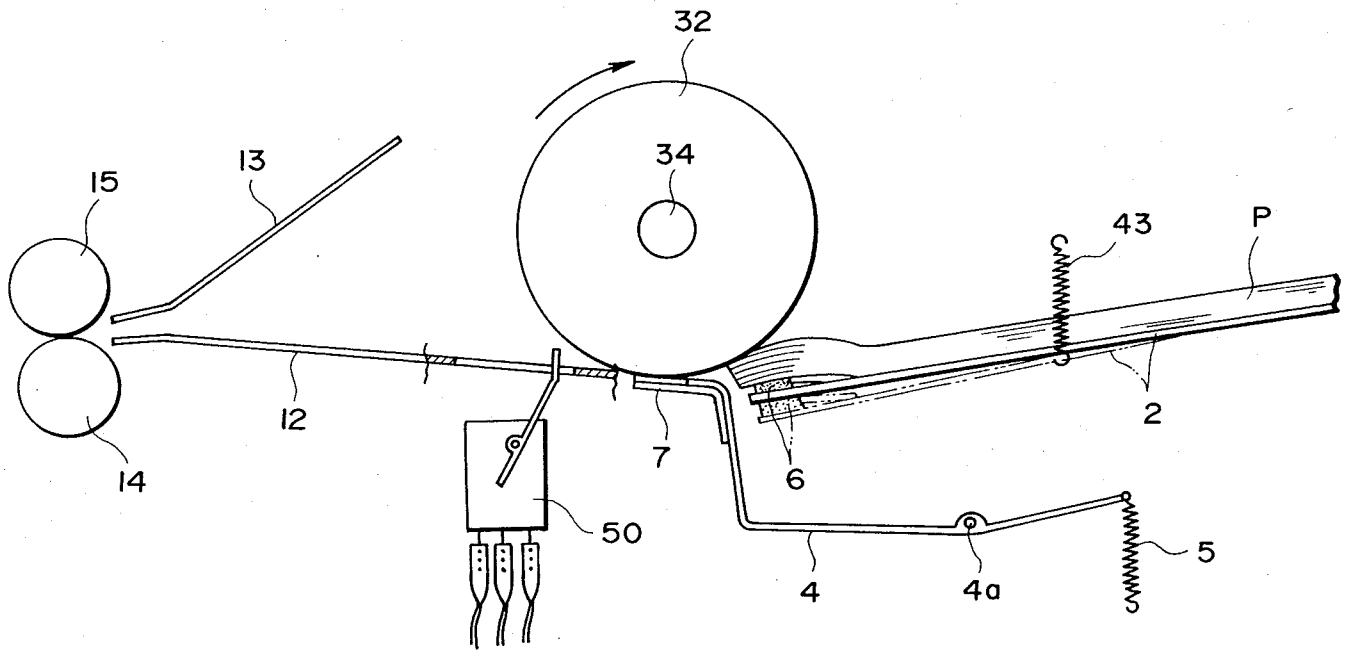
FIG. 3 is a side view illustrating the feeding apparatus and the mechanisms therearound.
Figure 4:
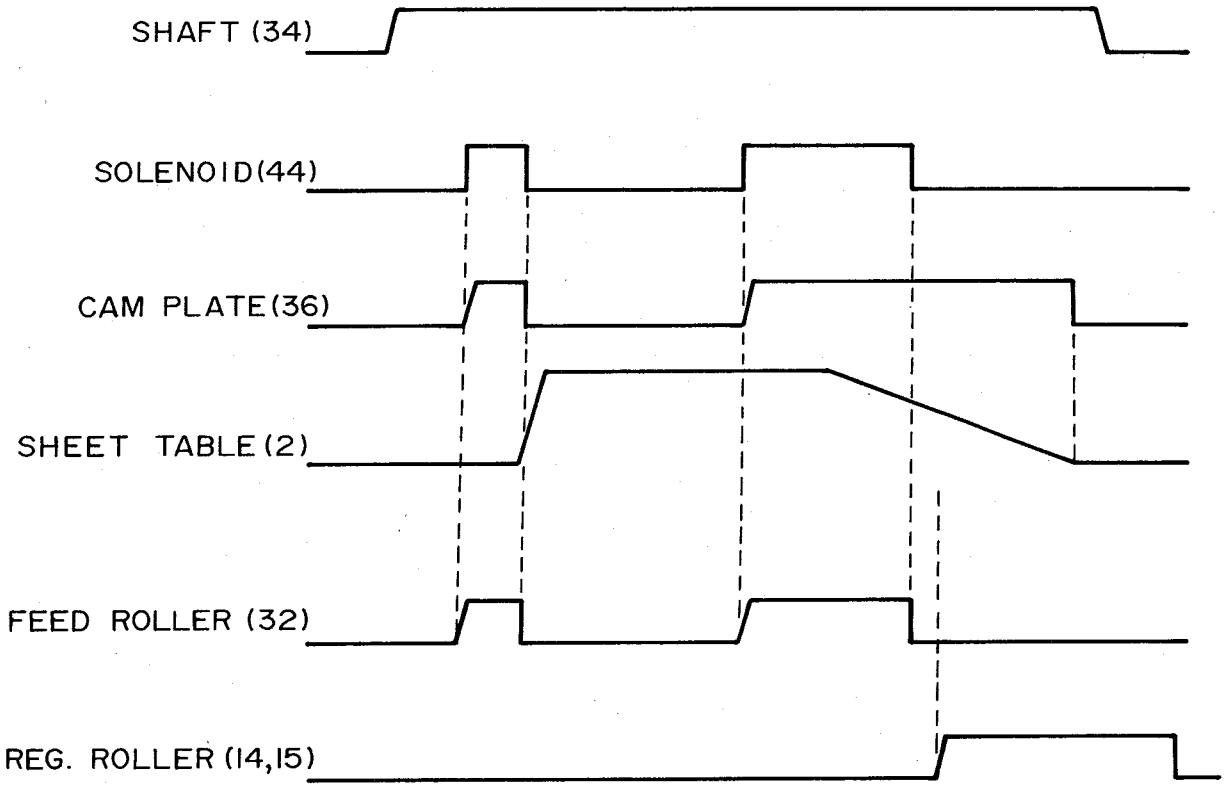
FIG. 4 is a time chart illustrating operation of the feeding apparatus.
Figure 5:
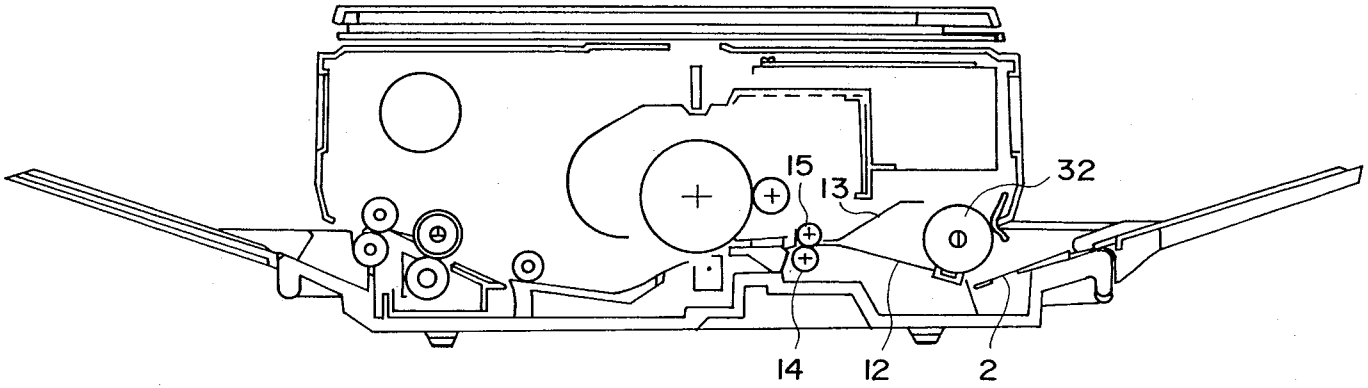
FIG. 5 is a sectional view of an example of a copying apparatus to which the feeding apparatus according to the present invention is used.
Figure 6:
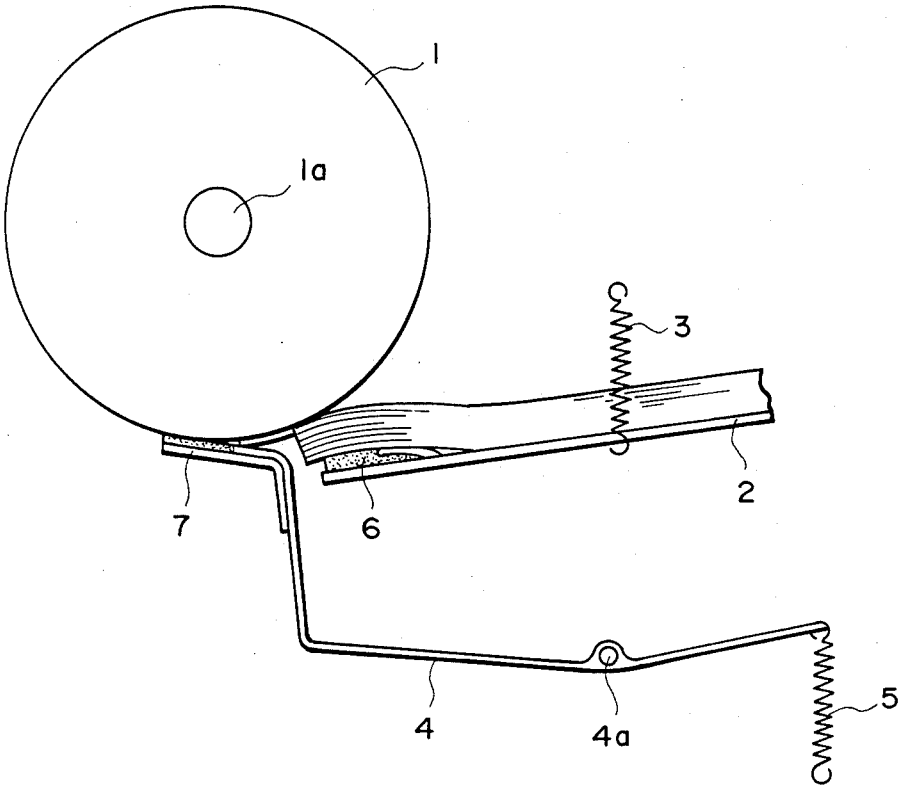
FIG. 6 PRIOR ART
FIG. 6 is a side view of a conventional feeding apparatus wherein the feeding roller is always contacted to the sheet.
Figure 7:
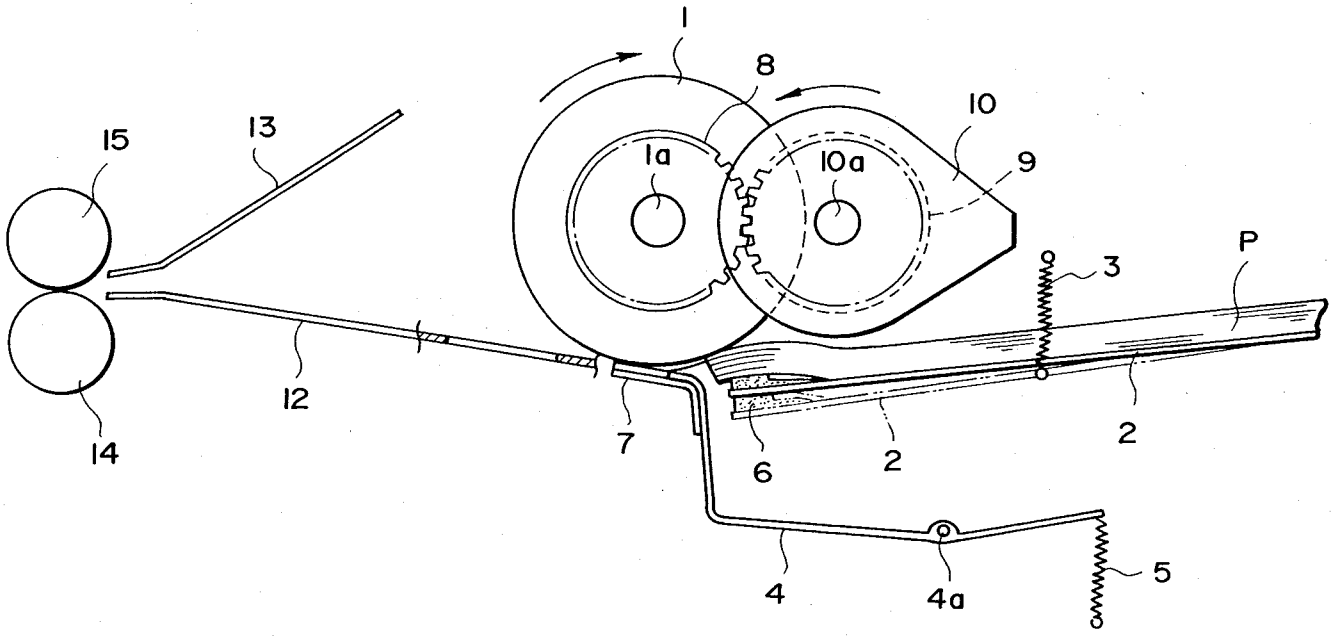
FIG. 7 PRIOR ART
FIG. 7 is a side view of a conventional feeding apparatus of the type wherein the feeding roller and the sheet are contacted.

The operation of the apparatus will be described, referring to FIGS. 1, 2 and 3.

Upon generation of a first feeding signal by an unshown control means, the solenoid 44 is energized to contract. By this, the lever 38 pivots in the counterclockwise direction so that the pawl 38*b* is disengaged from a first stopping pawl 37*a* of the control ring of the one rotation spring clutch 37. This permits rotation of the shaft 34. By this, the cam plate 36 which has kept lowering the stacking member 2, rotates in the clockwise direction, and therefore, the cam surface 36*a* is disengaged from the cam follower 41*a*. Then, the stacking member 2 moves up by the force of the spring 43, whereby the sheet material P is urged to the roller 32. On the other hand, at this time, the pawl 38*a* is disengaged from the spring clutch 35 so that the feeding roller 32 integral with the shaft 34 rotates for a very short period of time. This is not a problem because the sheet P is not yet contacted to the feeding roller 32. This will be further described in detail. The time period during which the lever 38 is operated by the solenoid 44 is 40 -50 msec., and the energization of the electromagnetic solenoid 44 is stopped immediately after the cam surface 36*a* of the cam plate 36 is disengaged from the cam follower 41*a*. Instantaneously upon deenergization of the solenoid 44, the lever 38 is restored to its rest position. By the restoring of the lever 38, the pawl 38*b* is engaged with a second stop pawl 37*b* so as to disengage one rotation spring clutch 37 to stop the rotation of the cam plate 36. Also, the pawl 38*a* is engaged with the pawl 35*a* of the spring clutch 35 so as to disengage the spring clutch 35 to stop the rotation of the feeding roller 32. Therefore, it is after the feeding roller 32 stops that the sheet material P is contacted and pressed to the feeding roller 32. By more finely dividing the pawls 35*a* of the spring clutch 35, for example, by dividing it into 45 -60 sections with regular circumferential intervals, the driving can be shut off with hardly any transmission of the driving force to the feeding roller 32.

After that, a second feeding signal is produced by the control means, so that the electromagnetic solenoid 44 contacts again, whereupon the lever 38 pivots counterclockwisely again. By this, the pawl 38*b* is disengaged from the second stop pawl 37*b* of the control ring of the one rotation spring clutch 37. Therefore, the driving force is transmitted, so that the shaft 34 starts rotating again. At this time, the cam plate 36 rotates also, however, the cam plate 36 is spaced away from the cam follower 41*a*, and therefore, no action is imposed on the cam follower. The contour of the cam is so determined as to accomplish this.

On the other hand, the pawl 38*a* is disengaged again from the spring clutch 35, simultaneously. The feeding roller 32 rotates together with the shaft 34 so as to feed the transfer material P to registration rollers 14 and 15. Thereafter, when the leading edge of the transfer sheet P is detected by a sensor 50, which is in the form of a microswitch in FIG. 3, the sheet advancing operation continues for a period of time which is required for the transfer sheets P to abut a nip formed between the registration rollers 14 and 15 (which is then not rotating) and forms a loop. Thereafter, the solenoid 44 is deenergized, by which the lever 38 restores by the function of the spring 45. Then, the pawl 38*a* is engaged with the pawl of the spring clutch 35 immediately thereafter. Therefore, the feeding roller 32 stops its rotation at this time, but the one rotation clutch 37 continues rotating until the first stop pawl 37*a* abuts the pawl 38*b* of the lever 38. In other words, the driving force to the shaft 34 ceases at a time corresponding to one rotation thereof after receiving the first feeding signal. At this time, the cam surface 36*a* of the cam plate 36 abuts again the cam follower 41*a* of the stacking member 2, thus lowering the stacking member 2. By this, the contact between the feeding roller 32 and the transfer paper P is stopped so as to allow the sheets to be supplied or exchanged without difficulty.

In the structure of this embodiment, the cam surface 36*a* lowers the cam follower 41*a* immediately after the start of the transfer sheet P. Therefore, double feeding can be prevented. It is added here that upon start of rotation of the registration rollers 14 and 15, the feeding roller 32 rotates following movement of the sheet due to the one way function of the spring clutch 35.

Since, the sheet is detected after the feeding thereof starts, and the feeding roller is stopped at a predetermined time after the detection signal thereof, a constant amount of the loop can always be formed before the registration roller even if the sheet feeding timing differs.

According to this embodiment, the rotation of the feeding roller 32 can be stopped at a desired angular position thereof without influence from the rotation of the cam plate 36. And, as described hereinbefore, two clutches which provide different rotational angles can be controlled by a single solenoid. Therefore, the parts arranged on two axes in the conventional apparatus, can be arranged coaxially so as to simplify the structure and reduce the size of the apparatus, although the present invention is not limited to the case where the two clutches are arranged coaxially.

In the foregoing description, the feeding shaft is controlled by a one rotation clutch, but it may be controlled such that it rotates two turns or one half turn, depending on the distance between the feeding roller and the registration roller.

While the invention has been described with reference to the structures disclosed herein, it is not confined to the details set forth and this application is intended to cover such modifications or changes as may come within the purposes of the improvements or the scope of the following claims.

What is claimed is:

1. A sheet feeding apparatus for feeding a sheet material, comprising:

(a) a sheet supporting member for supporting thereon a sheet material;

(b) a feeding roller for feeding the sheet material supported on said sheet supporting member;

(c) causing means for causing said feeding roller and the sheet material to engage or disengage with repect to each other;

(d) driving source for driving said feeding roller and said causing means;

(e) first transmitting means, coaxial with said feeding roller, for transmitting driving force from said driving source to said feeding roller;

(f) second transmitting means, coaxial with said feeding roller and said first transmitting means, for transmitting driving force from said driving source to said causing means; and (g) stop means movable between a position wherein said first and second transmitting means are allowed to rotate to transmit the driving force and a position wherein said first and second transmitting means are prevented from rotation to stop transmission of the driving force, wherein said causing means keeps said feeding roller and the sheet material disengaged from each other upon a non-feeding operation, and said stop means operates upon feeding operation so as to start rotation of said feeding roller after it is engaged with the sheet material.

2. An apparatus according to claim 1, wherein said first transmitting means for transmitting said driving force to said feeding roller comprises a one way clutch through which said feeding roller receives the driving force.

3. An apparatus according to claim 1, wherein said first transmitting means and said second transmitting means include respective clutches.

4. An apparatus according to claim 1, wherein said stop means includes a stop lever simultaneously actable on said first transmitting means and said second transmitting means.

5. An apparatus according to claim 1, wherein said causing means includes a cam mechanism.

6. An apparatus according to claim 1, wherein said causing means is actable on said sheet supporting member to effect engagement and disengagement between said feeding roller and said sheet material.

7. A sheet feeding apparatus for feeding a sheet material, comprising:

(a) a sheet supporting member for supporting thereon a sheet material;

(b) a feeding roller for feeding the sheet material supported on said sheet supporting member;

(c) causing means for causing said feeding roller and the sheet material to engage or disengage with respect to each other;

(d) driving source for driving said feeding roller and said causing means;

(e) first transmitting means for transmitting driving force from said driving source to said feeding roller, said first transmitting means including first engaging portions;

(f) second transmitting means for transmitting driving force from said driving source to said causing means, said second transmitting means including second engaging portions, the number of which is less than the number of said first engaging portions; and (g) stop means movable between a position wherein it is engaged with the first engaging portions and the second engaging portions to inhibit rotation of said first transmitting means and said second transmitting means to shut-off transmission of the driving force and a position wherein it is disengaged from the first engaging portions and from said second engaging portions so as to allow the rotation to allow transmission of the driving force, wherein said causing means keeps said feeding roller and the sheet material disengaged from each other upon a non-feeding operation, and said stop means operates upon feeding operation so as to start rotation of said feeding roller after it is engaged with the sheet material.

8. An apparatus according to claim 7, wherein said second transmitting means has two second engaging portions.

9. An apparatus according to claim 8, wherein said two second engaging portions comprise a disengagement portion for maintaining said causing means at a position for keeping disengagement between said feeding roller and the sheet material and a portion for keeping said causing means at a position for keeping engagement between said feeding roller and the sheet material.

10. An apparatus according to claim 9, wherein said second transmitting means includes a rotatable member having the second engaging portions on its periphery.

11. An apparatus according to claim 10, wherein said disengagement portion and engagement portion of said second engaging portions are close to each other, and wherein said disengagement portion is disposed downstream of said engagement portion with respect to a direction of rotation of said second switching means.

12. A sheet feeding apparatus for feeding a sheet material, comprising:

(a) a sheet supporting member for supporting thereon a sheet material;

(b) a feeding roller for feeding the sheet material supported on said sheet supporting member;

(c) means, coaxial with said feeding roller, for causing said feeding roller and the sheet material to engage or disengage with respect to each other;

(d) driving source for driving said feeding roller and said causing means;

(e) transmitting means, coaxial with said feeding roller, for transmitting driving force from said driving source to said feeding roller;

(g) stop means movable between a position wherein said transmitting means is allowed to transmit the driving force and a position wherein said transmitting means is prevented from transmitting the driving force.

13. An apparatus according to claim 12, wherein said causing means includes a cam mechanism.

14. An apparatus according to claim 12, wherein said feeding roller includes a one way clutch through which it receives the driving force.

15. An apparatus according to claim 12, wherein said transmitting means includes a spring clutch.

16. An apparatus according to claim 12, wherein said stop means includes a stop lever actable on said transmitting means.

17. An apparatus according to claim 12 or 13, wherein said causing means is actable on said sheet stacking member to effect engagement and disengagement between said feeding roller and said sheet material.

* * * * *